United States Patent [19]

Braun

[11] 4,040,132

[45] Aug. 9, 1977

[54] BACKSCRUBBER

[76] Inventor: George Braun, 471 Lakeshire Drive, Daly City, Calif. 94015

[21] Appl. No.: 659,980

[22] Filed: Feb. 20, 1976

[51] Int. Cl.[2] ..... A47K 3/22; A47K 7/00

[52] U.S. Cl. ..... 4/158; 128/44; 128/56

[58] Field of Search ..... 4/158; 128/56, 44

[56] References Cited

U.S. PATENT DOCUMENTS

| | | | |
|---|---|---|---|
| 1,965,774 | 7/1934 | Jaynes | 4/158 |
| 2,068,757 | 1/1937 | Mishelle | 4/158 |
| 3,091,776 | 6/1963 | Roberts | 4/158 |
| 3,196,867 | 7/1965 | Parry | 4/158 X |
| 3,372,604 | 3/1968 | Perry | 4/158 X |
| 3,768,462 | 10/1973 | Boulard | 4/158 |
| 3,862,459 | 1/1975 | Brunette | 4/158 X |

*Primary Examiner*—Henry K. Artis
*Attorney, Agent, or Firm*—George B. White

[57] ABSTRACT

A casing having a side open inwardly of a shower enclosure, and a plurality of cylindrical scrubbers rotatable in the casing and projecting out of said casing for contact with the back of a person; a transmission in a closed compartment adjacent to the casing is drivingly connected to the scrubbers; an electrical motor drive remote from the shower enclosure; and a flexible drive connecting the remote motor drive to said transmission; all electrical wiring and electrically charged parts being outside of and remote from the shower enclosure.

8 Claims, 7 Drawing Figures

FIG. 4
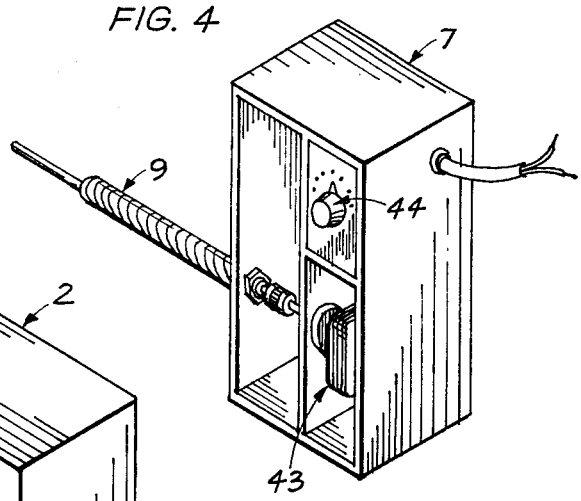
FIG. 5
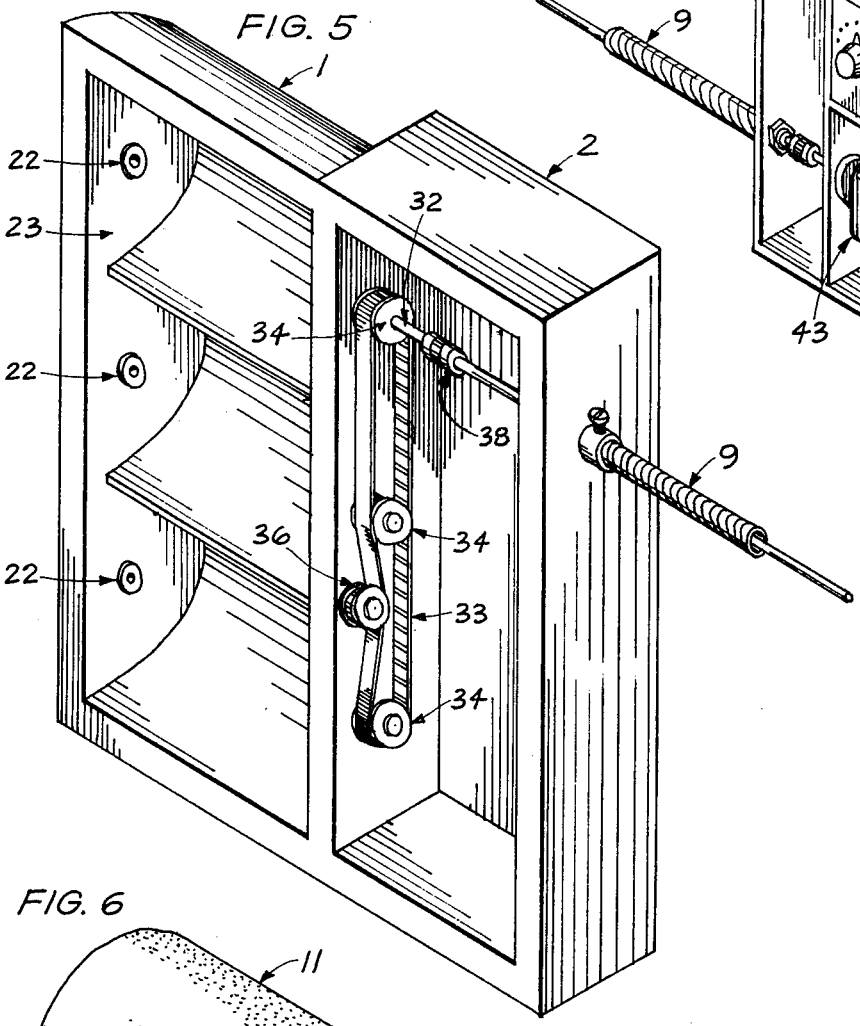
FIG. 6
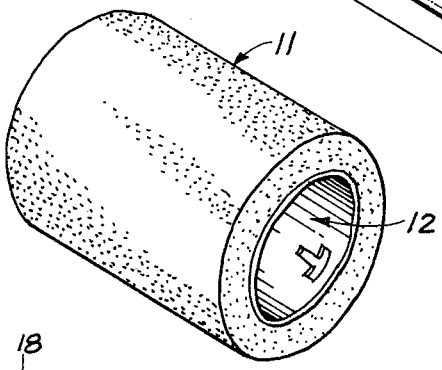
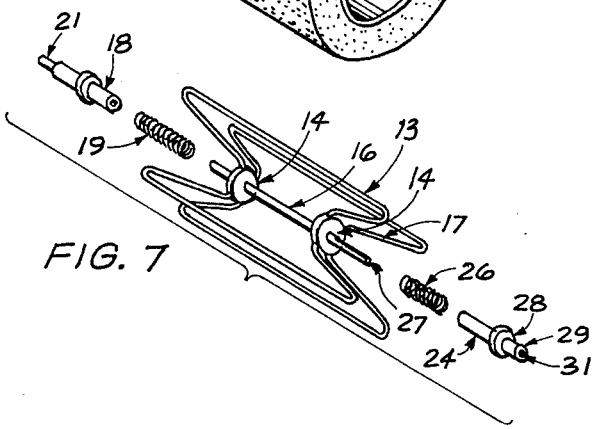
FIG. 7

BACKSCRUBBER

BACKGROUND OF THE INVENTION

Various types of back cleaners and massagers are known in the prior art, but the few which are electrically driven have their electrical lines or switches and electrical motors in the shower enclosure, thereby exposing the user to the danger of electrical shocks. Examples of such prior devices are U.S. Pat. No. 3,091,776 of P.S. Roberts and U.S. Pat. No. 2,196,867 of W. J. Perry, in which the respective electrical drives are in casings in the shower enclosure.

The primary object of this invention is to provide absolute safety from electrical shock to the user in the shower. The primary feature of this invention is to provide a separate motor drive remote from the shower enclosure, and a mechanical drive for scrubbers in the shower enclosure which is totally disassociated from any electrical wire or any electrical conductors.

BRIEF DESCRIPTION OF THE DRAWINGS

FIG. 4 is a perspective view of the power unit uncovered.

FIG. 5 is a perspective view of the scrubber casing and transmission unit uncovered with scrubbers removed, but the transmission in place.

FIG. 6 is a perspective view of a scrubber.

FIG. 7 is a perspective developed view of the axle and its support.

DETAILED DESCRIPTION

Figure 1:
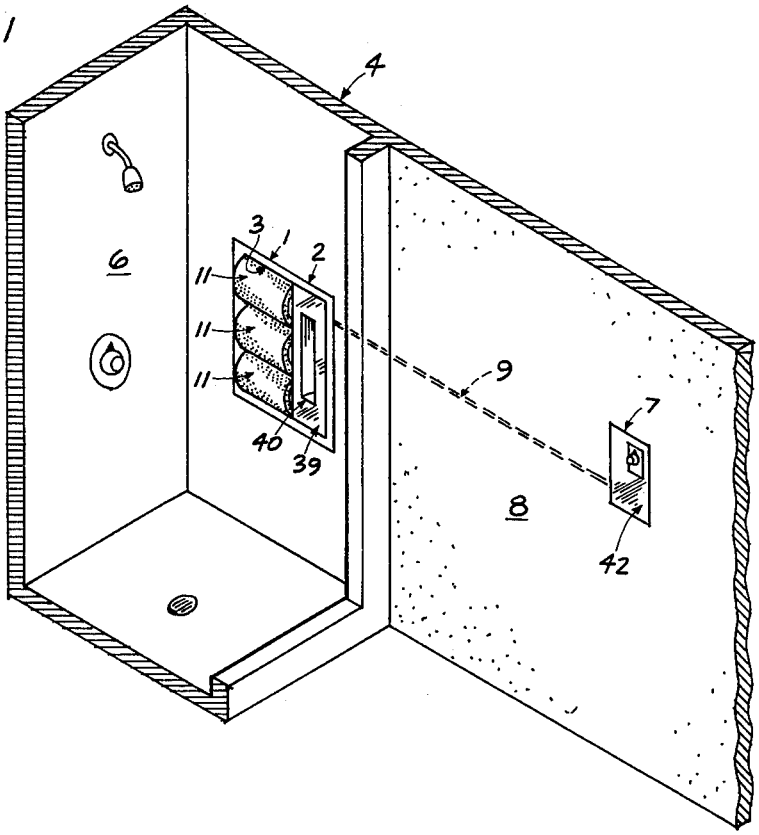
FIG. 1 is a perspective view of the scrubber and power unit relative to the shower enclosure.
Figure 2:
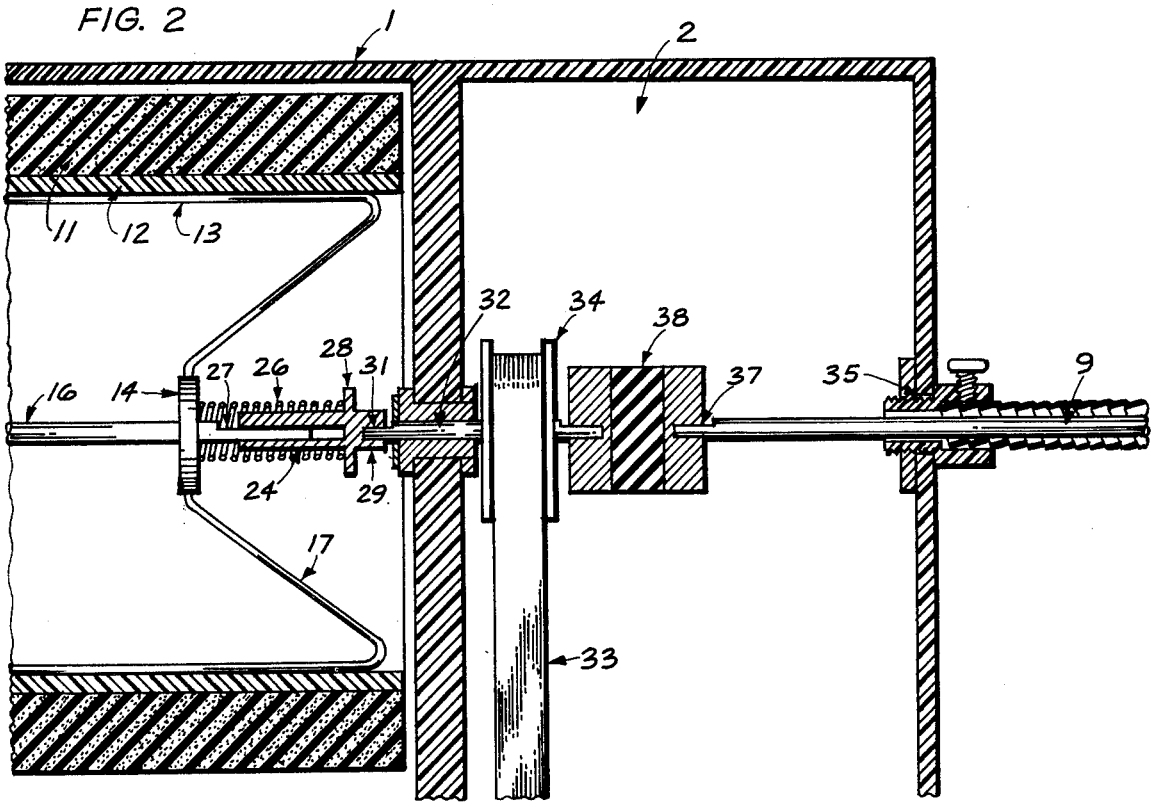
FIG. 2 is a fragmental sectional view of the drive connection.
Figure 3:
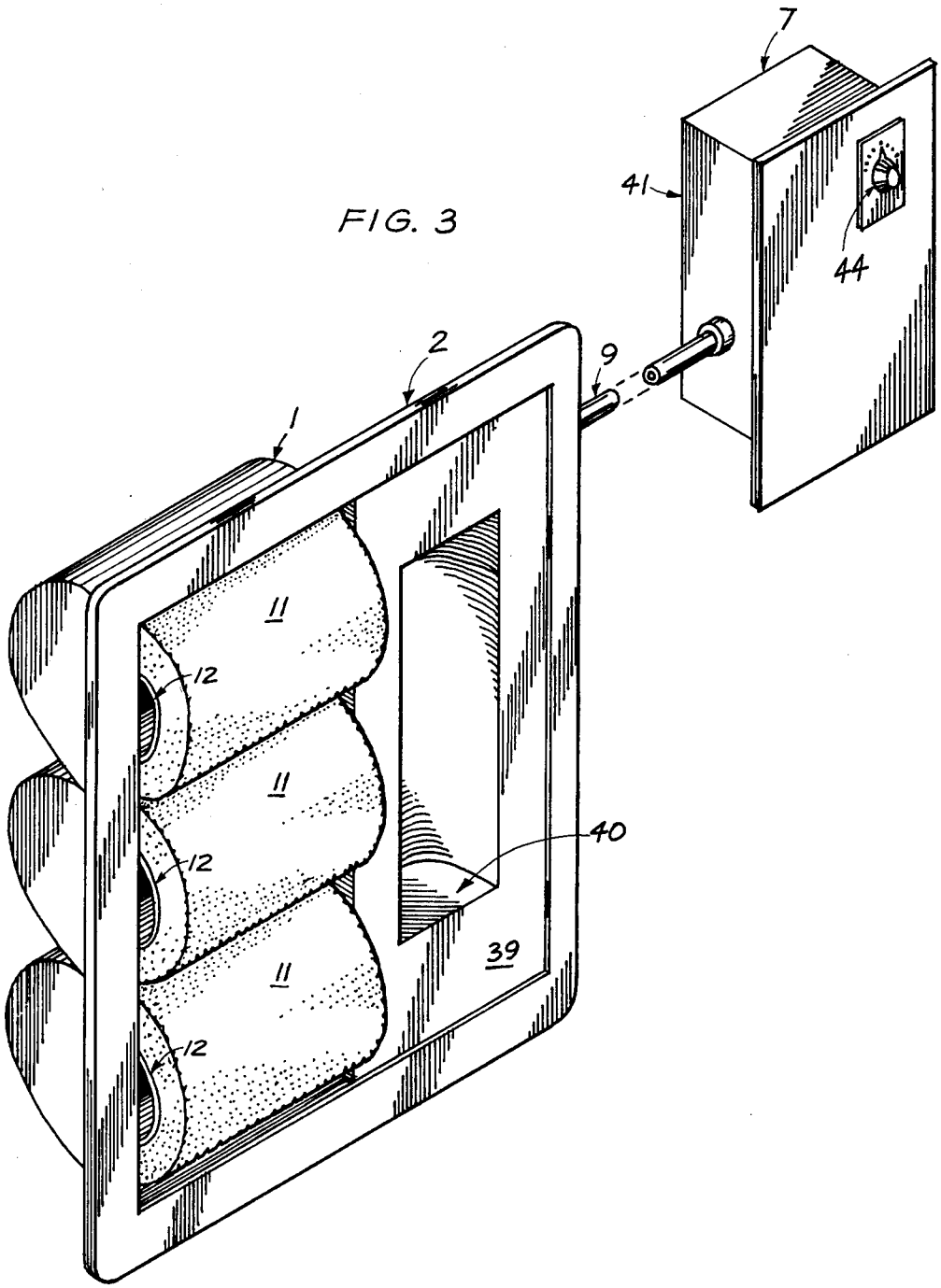
FIG. 3 is a perspective developed view of the remotely separate units on a larger scale.

A scrubber casing 1 and a transmission compartment 2 are in a unit adapted to be inserted in a recess 3 in a wall 4 of a shower enclosure 6. A power unit 7 is mounted on a wall 8 outside of the shower enclosure 6 and is connected by a flexible drive line 9 to the transmission in the transmission compartment 2.

The casing 1 and compartment 2 may be installed between the usual studs if wood framing is used in the wall 4, or the recess 3 may be suitably formed in masonry or other material. The height of installation in wall 4 is optimum for back scrubbing, for instance about 36 inches from the floor of the shower enclosure 6.

The casing 1, in the herein illustrative embodiment, has three semi-cylindrical portions so as to accommodate therein three cylindrical scrubbers 11 in such position that a part of each scrubber 11 projects inwardly of the shower enclosure 6.

Each scrubber 11 consists of a cylindrical exterior scrubber tube made of foam rubber or the like resiliently compressible material, on a waterproof, stiff, tubular core 12. Within the core is a resiliently compressible spring wire frame 13, the hubs 14 of which fixedly support an axle 16, as shown in FIG. 7. Each spring wire loop of the frame 13 extends axially in contact with the inner periphery of the core 12 and is at its ends 17 turned back upon itself and is secured to the adjacent hub 14. One end of the axle 16 has thereon a journal extension, which has a sleeve 18 fitting over a coil spring 19 on the end of the axle 16 bearing against the adjacent hub 14, and a journal pin 21 fitting into a journal bearing 22 on the side 23 of the casing farthest from the compartment 2.

On the other end of the axle 16 is a sleeve 24 surrounded by a spring. The sleeve 24 has a flattened axial cavity interlocking with a flat portion 27 on the end of the axle 16. The spring 26 bears against a flange 28 on the sleeve 24. A hub 29 on the flange 28 has a flat sided axial hole 31, therein with which interlocks the flat sided end of a drive shaft 32, thus the scrubbers can be easily replaced when needed by compressing the spring 19 or 26.

The transmission in the herein form is sprocket and belt type. A belt 33 is in engagement with sprockets 34 on the projecting ends of the driveshafts 32. A tension sprocket 36 bearing against the belt 33 assures driving engagement. The transmission compartment 2 has a suitable hole 35 for the flexible drive 9, the end 37 of which is detachably coupled with an insulating coupling 38. The top drive shaft 32 extends through the top sprocket 24 and is coupled with the coupling 38. A cover plate 39 provided with an indent 40 for soap or the like covers the transmission compartment 2.

The power unit 7 is in a box 41 having a detachable cover 42. In the box 41 is an electrical motor 43 suitably geared for rotating the flexible drive shaft 9 which is the usual drive cable within a flexible armor. A timer switch 44 on the box 42 closes the electrical circuit between the usual electrical conduit and the motor 43.

In operation, the person sets the timing switch, then enters the shower enclosure 6 and while the person takes a shower by simply leaning against the rotating scrubbers can have the back scrubbed without any danger of electric shock.

I claim:

1. In a remotely driven backscrubber device for a bath enclosure, the combination with a casing open inwardly of the enclosure, at least one cylindrical scrubber rotatably mounted in said casing and partially projecting into said enclosure, a closed compartment adjacent said casing, transmission means in said compartment, and means to drivingly connect said transmission means to said scrubber for transmitting rotation to said scrubber, of a motor case mounted remotely from said casing and said closed compartment and entirely outside of said enclosure, an electric motor drive in said case, an insulated drive line extended from said electric motor drive into said closed compartment, insulated means in said closed compartment to couple said drive line to said transmission means to transmit rotation from said remote motor drive to said scrubber

2. The remotely driven back scrubber specified in claim 1, and said casing and said compartment being unitary and being adapted to be mounted on a wall of said enclosure in position for said scrubber to project beyond said wall into said enclosure in convenient position for scrubbing, a cover of said compartment having a recess forming a soap tray.

3. The remotely driven back scrubber specified in claim 1, and said cylindrical scrubber comprising, a waterproof core, a resiliently compressible tube on said core,
an axle in said core
a spring-wire axle frame drivingly supporting said axle in said core,
and journal means on the sides of said casing for rotatably supporting said axle.

4. The remotely driven back scrubber specified in claim 3, and
there being a plurality of back scrubbers in said casing,
said transmission means including
axle means in each cylindrical scrubber journalled in the sides of said casing,
an element on one end of each axle means extending into said closed compartment,
said transmission means being drivingly connected to said one ends for imparting rotation to said axles.

5. The remotely driven back scrubber specified in claim 4, and
said means to couple said flexible drive line including,
a coupling element in said compartment related to one of said one axle ends,
and a connecting element on said drive line drivingly connected to said coupling element for rotating said transmission means and said axles.

6. The remotely driven back scrubber specified in claim 1, and
there being a plurality of cylindrical scrubbers in said casing,
each scrubber including
a waterproof core,
a scrubber tube on the core,
an axle frame in each core drivingly engaging said core,
an axle supported on each axle frame,
journal means on the sides of said casing for journalling said axle.

7. The remotely driven back scrubber specified in claim 6, and
a drive element extending from each axle into said compartment,
said transmission means engaging said drive elements for imparting rotation to said axles and to said scrubber tubes.

8. The remotely driven back scrubber specified in claim 7, and
said transmission means including
driving means connected to said axles,
and said means to couple said drive line to said transmission means including detachable connecting elements.

* * * * *